US009644506B2

(12) United States Patent
Bidner et al.

(10) Patent No.: US 9,644,506 B2
(45) Date of Patent: May 9, 2017

(54) METHOD AND SYSTEM OF OIL DELIVERY IN A COMBUSTION ENGINE

(71) Applicant: Ford Global Technologies, LLC, Dearborn, MI (US)

(72) Inventors: David Karl Bidner, Livonia, MI (US); Vladimir V. Kokotovic, Bloomfield Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 343 days.

(21) Appl. No.: 14/225,321

(22) Filed: Mar. 25, 2014

(65) Prior Publication Data

US 2015/0275713 A1 Oct. 1, 2015

(51) Int. Cl.

| | |
|---|---|
| ***F01M 1/02*** | (2006.01) |
| ***F01P 3/08*** | (2006.01) |
| ***F01P 5/10*** | (2006.01) |
| ***F01M 1/12*** | (2006.01) |
| *F01M 1/08* | (2006.01) |

(52) U.S. Cl.

CPC ..... *F01M 1/02* (2013.01); *F01M 1/12* (2013.01); *F01P 3/08* (2013.01); *F01P 5/10* (2013.01); *F01M 2001/086* (2013.01); *F01M 2001/123* (2013.01)

(58) Field of Classification Search

CPC .. F01P 3/00; F01P 2003/006; F01P 2003/027; F01P 3/06; F01P 3/08; F01P 5/10; F01M 1/02; F01M 1/12

See application file for complete search history.

(56) References Cited

U.S. PATENT DOCUMENTS

| | | | | |
|---|---|---|---|---|
| 4,854,276 | A * | 8/1989 | Elsbett | F01M 1/12 123/196 AB |
| 8,714,123 | B2 | 5/2014 | Rollinger et al. | |
| 8,739,746 | B2 | 6/2014 | Bidner et al. | |
| 2005/0120982 | A1 | 6/2005 | Ducu | |
| 2010/0284824 | A1* | 11/2010 | Hippen | F01M 11/02 417/44.1 |
| 2012/0251354 | A1* | 10/2012 | Kogure | F04B 17/03 417/410.1 |
| 2012/0296518 | A1* | 11/2012 | Bruno | F01M 1/20 701/34.4 |
| 2013/0179049 | A1 | 7/2013 | Grieser et al. | |
| 2013/0192557 | A1 | 8/2013 | Rollinger et al. | |

OTHER PUBLICATIONS

Bidner, David K. et al., "System and Method for Cooling Engine Pistons," U.S. Appl. No. 13/789,134, filed Mar. 7, 2013, 29 pages.

* cited by examiner

*Primary Examiner* — Jacob Amick

(74) *Attorney, Agent, or Firm* — Julia Voutyras; Alleman Hall McCoy Russell & Tuttle LLP

(57) ABSTRACT

Methods and systems are described for an oil delivery system of an engine. In one method, oil is pumped via a lower pressure oil pump to piston cooling jets while oil is separately pumped via a higher pressure oil pump to a cylinder head, bearings, a turbocharger, or a variable valve operation system. Herein, the higher and lower pressure oil pumps each draw oil from a common, shared sump, and return oil back to the common, shared sump.

20 Claims, 6 Drawing Sheets

METHOD AND SYSTEM OF OIL DELIVERY IN A COMBUSTION ENGINE

TECHNICAL FIELD

The present application relates to systems and methods for supplying oil in an engine.

BACKGROUND AND SUMMARY

Vehicles may use an engine oil system to lubricate and/or cool various components of an internal combustion engine. The oil system for an engine supplies oil from a reservoir, often referred to as a sump, to various components of the engine requiring a supply of oil, such as bearings, hydraulic valve mechanisms, and piston cooling jets.

As such, there may be many competing and overlapping demands on an engine oil system during vehicle operation. For example, different engine components may have different oil flow volume and oil pressure requirements. Further, the oil requirement for a given component may vary depending on operating conditions (e.g., engine load, engine temperature, etc.).

One approach to address the differing oil requirements of the various engine components includes the use of check valves and control valves to modify oil routing, oil pressure activation, etc. In another approach shown by Ducu in US 2005/0120982, a separate oil gallery, in addition to a main oil gallery, is provided for piston cooling. A single pump supplies oil to the main and the separate oil galleries. An electronic control valve controls the flow of oil into the separate gallery based on engine load and engine temperature. Oil supply to the separate gallery, and therefore, to the pistons, may be stopped by closing the control valve when engine temperature and/or engine loads are lower.

However the inventors herein have identified potential issues with the above approaches. For example, since a single oil pump is utilized to provide oil to different engine components, it has to be sized to meet high flow volumes for piston cooling. Thus, even though a separate gallery is used to supply oil to piston cooling jets, by using a single, oversized pump, there is an increase in power consumption and a loss in fuel economy. As another example, even though check valves and control valves may stop or reduce the flow to specific components, a single oil pump may continue to provide oil to a common oil gallery at a pressure requested by the highest requester, resulting in a loss of hydraulic power and a waste of energy.

The inventors herein have identified an approach to at least partly address the above issues. In one example approach, a method for an engine is provided comprising, pumping oil via a lower pressure pump to piston cooling jets while separately pumping oil via a higher pressure oil pump to a cylinder head. In this way, distinct pumps can be employed to supply oil at different pressures and volumes as demanded by different components of the engine.

For example, an oil delivery system in an engine may comprise at least two electric oil pumps, each drawing oil from a common, shared oil sump and returning oil back to the common, shared sump independent of each other. One pump may be a lower pressure pump communicating fluidly with a low pressure circuit which supplies oil at lower pressure to cool pistons via piston cooling jets. The other pump may be a higher pressure pump fluidly coupled to a high pressure circuit which provides oil at a higher pressure to a cylinder head, bearings, a variable valve operation system and/or a turbocharger. Thus, during engine operation, the lower pressure pump may supply oil only to piston cooling jets, and may not supply oil to the cylinder head, bearings, the variable valve operation system or a turbocharger. Simultaneously, the higher pressure pump may deliver oil only to the cylinder head, bearings, the variable valve operation system and/or the turbocharger, and may not provide oil to the piston cooling jets.

In this way, oil may be supplied separately to different groups of engine components, the components grouped based on their differing oil pressure and flow requirements, without incurring a loss in hydraulic power. By using separate pumps, each pump may be activated independently based on the lubrication and/or cooling requirements of components coupled to a given pump. Further, the pumps may be simultaneously operated at different speeds and pressures based on existing engine operating conditions and component requirements. As such, this allows each pump to be sized according to the specific output demands made on that pump, enabling a reduction in power consumption and consequently, an improvement in fuel economy. Thus, non-overlapping pressure and flow conditions may be satisfied by grouping components having higher flow and lower pressure lubrication requirements separate from lower flow and higher pressure lubrication requirements, while offering the flexibility to modify pump operation with operating conditions, such as warm-up temperature profiles.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
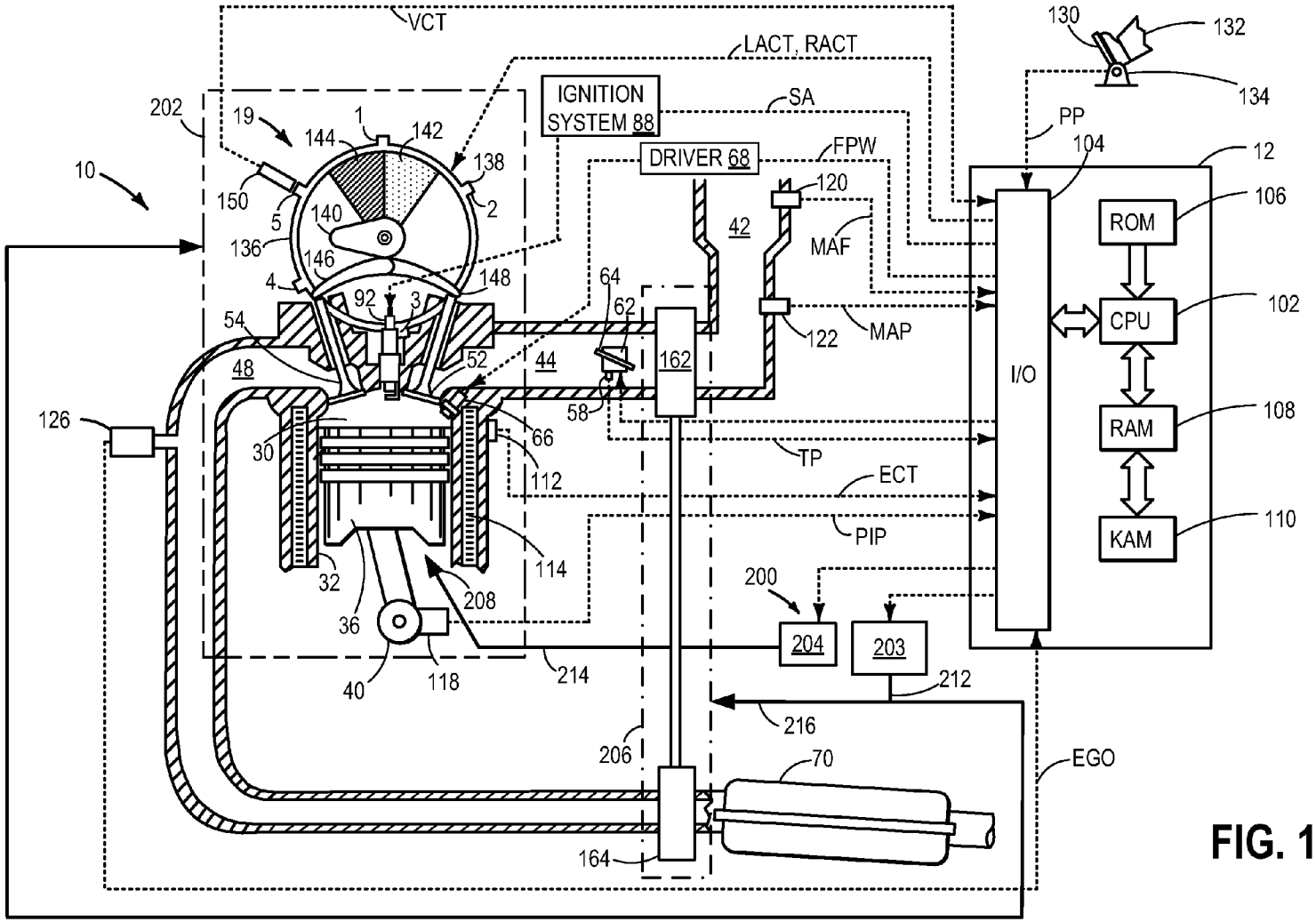
FIG. 1 shows a schematic diagram of an example engine.
Figure 2:
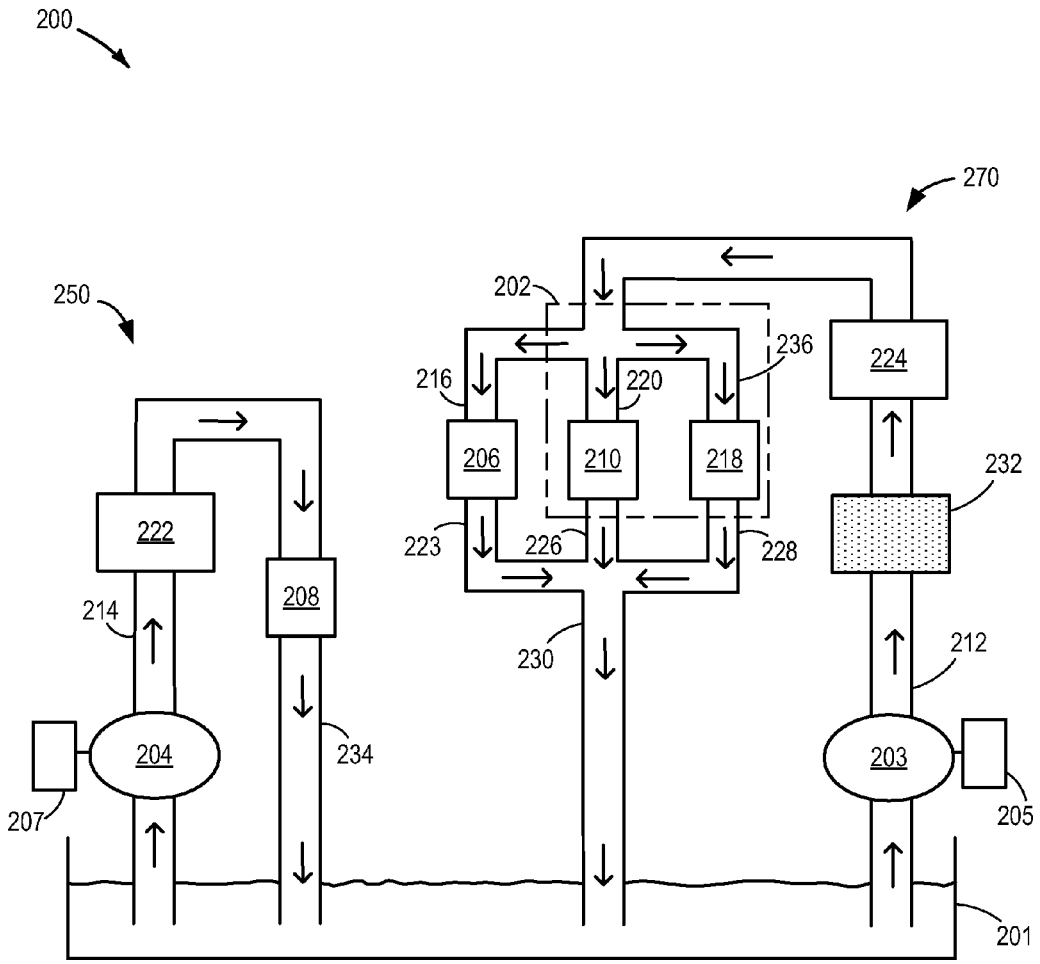
FIG. 2 portrays a block diagram of an engine oil delivery system in accordance with the present disclosure.
Figure 5:
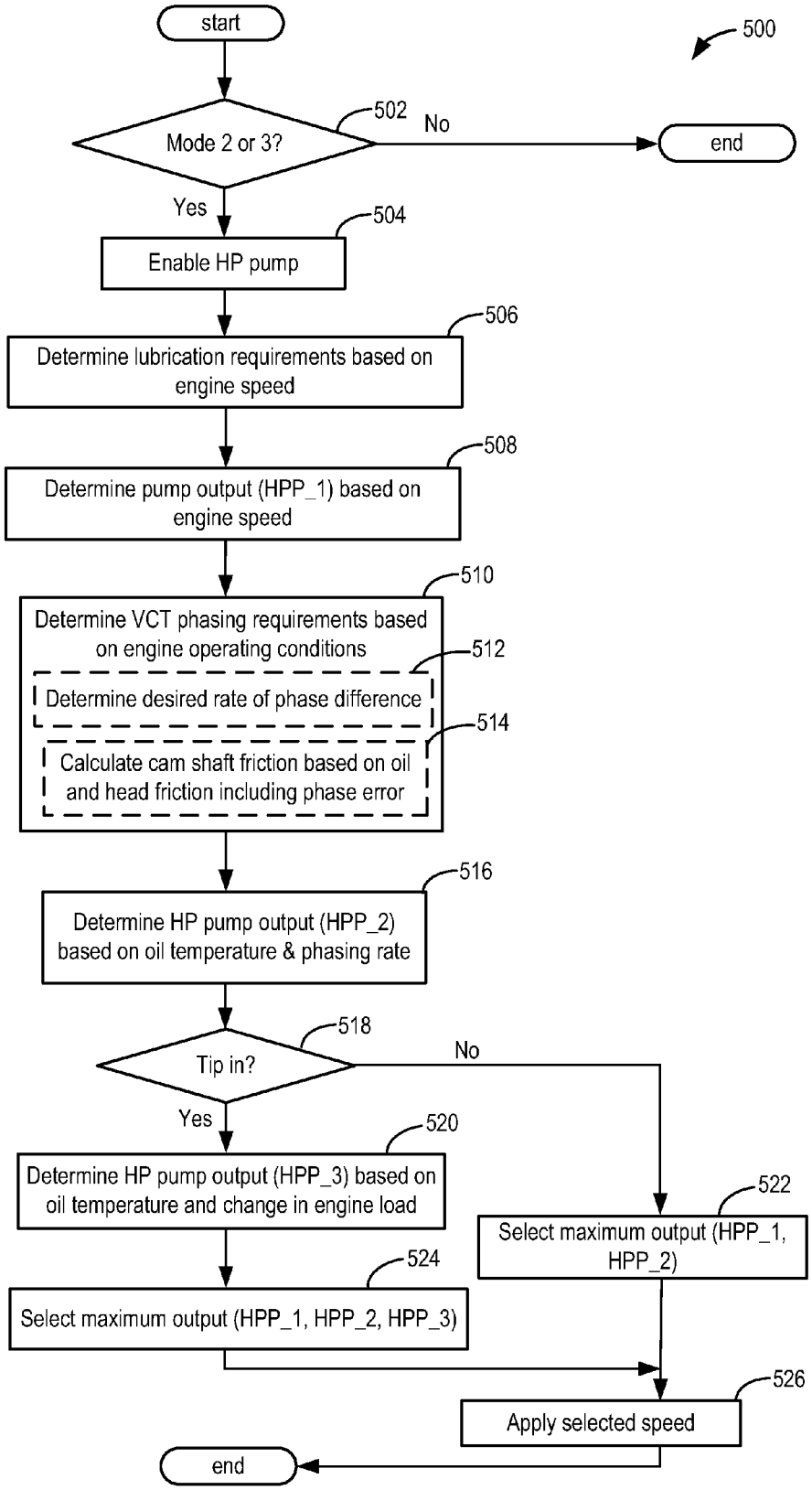
FIG. 5 shows an example flowchart for operating a higher pressure oil pump based on engine conditions and requests from the components coupled to the higher pressure oil pump.
Figure 6:
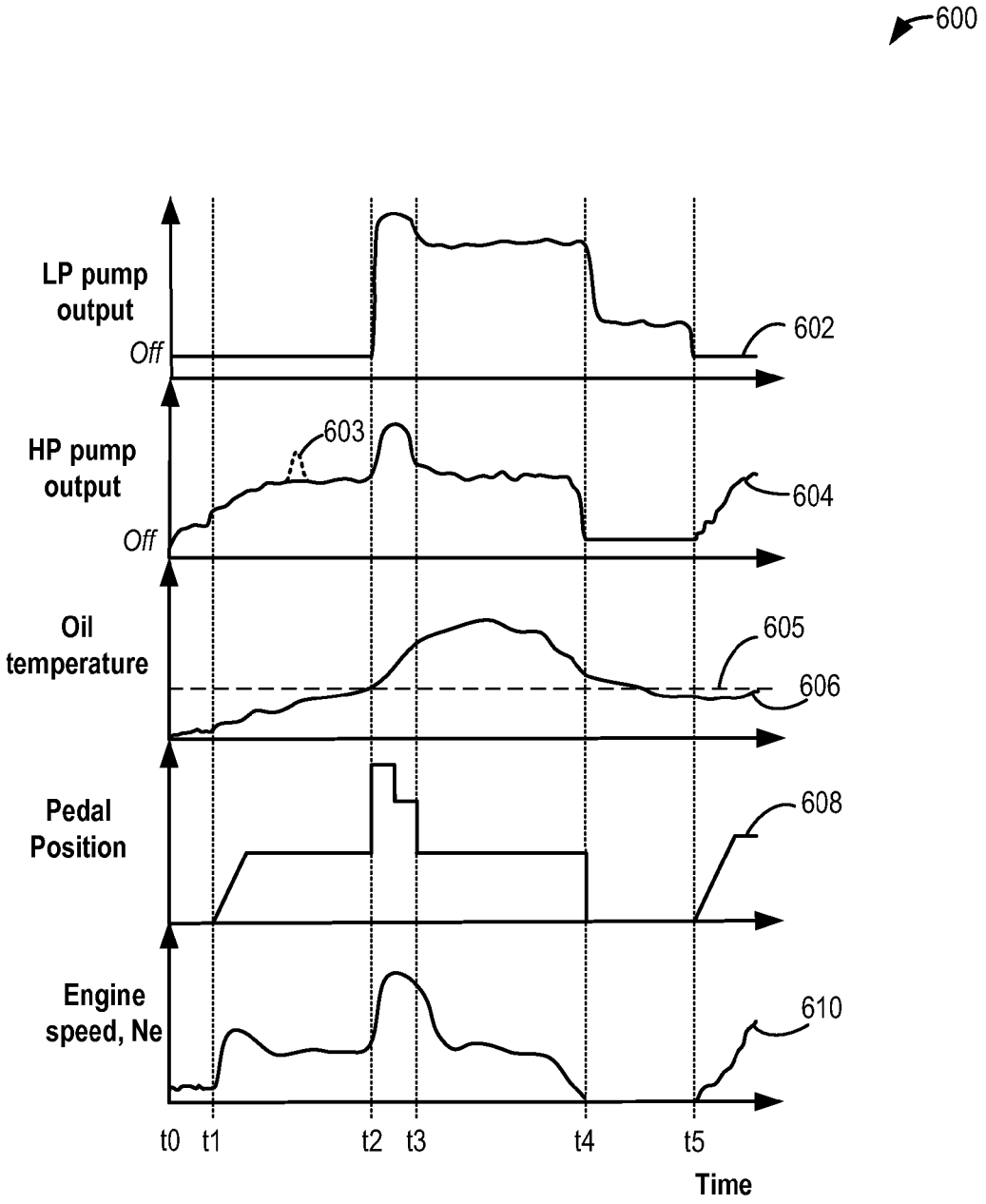
FIG. 6 illustrates an example operation of the higher pressure and lower pressure oil pumps, according to the present disclosure.

The following description relates to an oil delivery system for an engine, such as that of FIG. 1, which includes a high pressure circuit and a low pressure circuit wherein, each circuit is coupled to a separate pump. A lower pressure pump, fluidly coupled to the low pressure circuit, selectively pumps oil to piston cooling jets, and a higher pressure pump, fluidly coupled to the high pressure circuit, selectively pumps oil to a cylinder head, bearings, turbocharger, and a variable cam timing system as shown in FIG. 2. A controller may be configured to perform a routine, such as the example routine of FIG. 3, to determine an operating mode for the two pumps based on engine cooling and lubrication requirements. For example, the controller may operate the oil system in a first mode where only the lower pressure pump is operated (FIG. 4), a second mode where only the higher pressure pump is operated (FIG. 5), and a third mode for operating both pumps concurrently. Example pump operations are shown at FIG. 6.

FIG. 1 is a schematic diagram showing one cylinder of a multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional, pedal position signal PP.

Engine 10 shows an example cylinder 30 (also known as combustion chamber 30) that is part of a combination region 202 including a cylinder head and an engine block. The cylinder head may include one or more valves for selectively communicating with an intake and an exhaust system, for example, while the engine block may include multiple cylinders, a crankshaft, etc. It will be appreciated that region 202 may include additional and/or alternative components than those illustrated in FIG. 1 without departing from the scope of this disclosure.

Cylinder 30 of engine 10 includes cylinder walls 32 with piston 36 positioned therein. Piston 36 is shown coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Cylinder 30 receives intake air from intake manifold 44 via intake passage 42 and exhausts combustion gases via exhaust passage 48. Intake manifold 44 and exhaust passage 48 can selectively communicate with cylinder 30 via respective intake valve 52 and exhaust valve 54. In some embodiments, cylinder 30 may include two or more intake valves and/or two or more exhaust valves.

Engine 10 also includes a compression device such as a turbocharger 206 comprising at least a compressor 162 arranged within intake passage 42. Compressor 162 may be at least partially driven by a turbine 164 (e.g. via a shaft) arranged along exhaust passage 48.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into cylinder 30. The fuel injector may be mounted on the side of the combustion chamber or in the top of the cylinder, for example. Fuel may be delivered to fuel injector 66 by a fuel delivery system (not shown) including a fuel tank, a fuel pump, and a fuel rail. In some embodiments, combustion chamber 30 may alternatively or additionally include a fuel injector arranged in intake passage 42 in a configuration that provides what is known as port injection of fuel into the intake port upstream of cylinder 30.

Intake passage 42 is shown with throttle 62 including throttle plate 64 whose position controls airflow. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to cylinder 30 along with other cylinders within engine 10. Intake passage 42 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Engine 10 includes an oil delivery system 200 for providing engine component cooling and lubrication. Oil delivery system 200 includes a lower pressure electric oil pump 204 and a higher pressure electric oil pump 203 that receive instructions from controller 12. Oil pumped by lower pressure electric oil pump 204 is routed through channel 214 to a first group of components grouped based on their higher flow and/or lower pressure requirements. For example, oil may be pumped by lower pressure electric oil pump 204 through channel 214 to cool an underside of piston 36 via piston cooling jets 208. Oil is pumped by higher pressure electric oil pump 203 via channel 212 to a second group of components including, for example, turbocharger 206, bearings (not shown), and a variable camshaft timing system 19 in the cylinder head and engine block region 202. The second group of components may be grouped based on their higher pressure and lower oil flow requirements for component cooling and lubrication. An example oil delivery system configuration, according to this disclosure, is described further below in reference to FIG. 2.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

Cylinder head and engine block region 202 houses a variable valve operation system such as a variable camshaft timing (VCT) system 19. In this example, an overhead cam system is illustrated, although other approaches may be used. Specifically, camshaft 140 of engine 10 is shown communicating with rocker arms 148 and 146 for actuating intake valve 52 and exhaust valve 54, respectively. VCT system 19 may be oil-pressure actuated (OPA), cam-torque actuated (CTA), or a combination thereof. By adjusting a plurality of hydraulic valves to thereby direct a hydraulic fluid, such as engine oil, into the cavity (such as an advance chamber or a retard chamber) of a camshaft phaser, valve timing may be changed (e.g., advanced or retarded). The operation of the hydraulic control valves may be controlled by respective control solenoids. Specifically, an engine controller may transmit a signal to the solenoids to move a valve spool that regulates the flow of oil through the phaser cavity. As used herein, advance and retard of cam timing refer to relative cam timings, in that a fully advanced position may still provide a retarded intake valve opening with regard to top dead center, as an example.

Camshaft 140 is hydraulically coupled to housing 136. Housing 136 forms a toothed wheel having a plurality of teeth 138. In the example embodiment, housing 136 is mechanically coupled to crankshaft 40 via a timing chain or belt (not shown). Therefore, housing 136 and camshaft 140 rotate at a speed substantially equivalent to each other and synchronous to crankshaft 40. In an alternate embodiment, as in a four stroke engine, for example, housing 136 and crankshaft 40 may be mechanically coupled to camshaft 140 such that housing 136 and crankshaft 40 may synchronously rotate at a speed different than camshaft 140 (e.g. a 2:1 ratio, where the crankshaft rotates at twice the speed of the camshaft). In the alternate embodiment, teeth 138 may be mechanically coupled to camshaft 140.

By manipulation of the hydraulic coupling as described herein, the relative position of camshaft 140 to crankshaft 40 can be varied by hydraulic pressures in retard chamber 142 and advance chamber 144. For example, by allowing high pressure hydraulic fluid to enter retard chamber 142, the relative relationship between camshaft 140 and crankshaft 40 may be retarded. As a result, intake valve 52 and exhaust valve 54 may open and close at a time later than normal relative to crankshaft 40. Similarly, by allowing high pressure hydraulic fluid to enter advance chamber 144, the relative relationship between camshaft 140 and crankshaft 40 may be advanced. As a result, intake valve 52 and exhaust valve 54 may open and close at a time earlier than normal relative to crankshaft 40.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valve train may be roller finger follower, direct acting mechanical bucket, electrohydraulic, or other alternatives to rocker arms.

Continuing with VCT system 19, teeth 138, rotating synchronously with camshaft 140, allow for measurement of relative cam position via cam timing sensor 150 providing signal VCT to controller 12. Teeth 1, 2, 3, and 4 may be used for measurement of cam timing and are equally spaced (for example, in a V-8 dual bank engine, spaced 90 degrees apart from one another) while tooth 5 may be used for cylinder identification. In addition, controller 12 sends control signals (LACT, RACT) to conventional solenoid valves (not shown) to control the flow of hydraulic fluid either into retard chamber 142, advance chamber 144, or neither. In one embodiment, the high pressure hydraulic fluid may be the oil pumped by the higher pressure electric oil pump 203.

Relative cam timing can be measured in a variety of ways. In general terms, the time, or rotation angle, between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

As described above, FIG. 1 shows only one cylinder of a multi-cylinder engine, and each cylinder may similarly include its own set of intake/exhaust valves, fuel injector, ignition system, etc.

Controller 12 is shown in FIG. 1 as a microcomputer, including microprocessor unit 102, input/output ports 104, an electronic storage medium with non-transitory memory for executable programs and calibration values, shown as read only memory chip 106 in this particular example, random access memory 108, keep alive memory 110, and a data bus. Controller 12 is shown receiving various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Further, controller 12 receives input regarding a temperature of engine oil from an engine oil temperature sensor (not shown) and a piston metal temperature from an infrared sensor. Such information may be used to determine a mode of operation for the oil delivery system, and outputs for each of the pumps as will be described in more detail below with respect to FIGS. 3, 4 and 5.

Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, Hall effect sensor 118, which is also used as an engine speed sensor, produces a predetermined number of equally spaced pulses every revolution of the crankshaft. As will be described below, engine speed measurements from the engine speed sensor may be used to determine oil pump output.

Storage medium read-only memory 106 can be programmed with computer-readable data representing instructions executable by processor 102 for performing the methods described below as well as variations thereof.

FIG. 2 shows a schematic diagram of an example oil delivery system 200 that may be included in engine 10 of FIG. 1. As such, components previously introduced in FIG. 1 are numbered similarly in FIG. 2 and not reintroduced.

Oil delivery system 200 may supply oil to various engine locations to perform functions such as component cooling, lubrication, actuation of an actuator, etc. As shown, oil delivery system 200 includes a low pressure circuit 250 that delivers oil at a lower pressure to a first group of components including piston cooling jets 208. Oil delivery system 200 further includes a high pressure circuit 270 that provides oil at a higher pressure to a second group of components including miscellaneous bearings within cylinder head and engine block region 202, and turbocharger 206. In alternate examples, other components may be included in each of the first and second groups. The first and second group of components are grouped based on their cooling and lubrication requirements. For example, the first group of components are grouped based on high flow and low pressure requirements while the second group of components are grouped based on high pressure and low flow requirements.

Low pressure circuit 250 comprises a lower pressure (LP) oil pump 204. The lower pressure oil pump is an electrically actuated pump in the depicted embodiment, the pump coupled to a first electric motor 207 that may be powered by a system battery (not shown). High pressure circuit 270 includes a higher pressure (HP) oil pump 203. The higher pressure oil pump is also an electrically actuated pump in the depicted embodiment, the pump coupled to a second electric motor 205. Second electric motor 205 may also receive power from the system battery. Low pressure circuit 250 and high pressure circuit 270 are fluidically separate from each other and may be operated independent of each other. The two circuits may also be operated simultaneously. Further, an output of LP oil pump 204 may be regulated by adjusting the first electric motor 207, while an output of the HP oil pump may be modified by adjusting the second electric motor 205. Each of the two circuits separately draws oil from a common oil sump 201 and returns the oil back to oil sump 201.

LP oil pump 204, in association with first electric motor 207, draws oil from oil sump 201, through oil intake channel 214. Oil is delivered from LP oil pump 204 under pressure, through oil cooler 222, to piston cooling jets 208. The low pressure circuit 250 does not include a filter. Oil returns to oil sump 201 at atmospheric pressure through return channel 234. Thus, in low pressure circuit 250, oil is pumped via LP oil pump 204 to piston cooling jets 208 before returning said oil to oil sump 201. Since piston cooling via piston cooling jets demands high volumes of oil at lower pressure, LP oil pump 204 may be sized differently from HP oil pump 203 to meet these demands. For example, LP oil pump 204 may have a larger flow rate than HP oil pump 203. Further, at a given engine operating condition, such as high engine loads, when piston temperatures are higher, LP oil pump 204 may pump oil at a higher flow rate than HP oil pump 203 to cool the pistons.

HP oil pump 203, in association with second electric motor 205, draws oil from oil sump 201, through oil intake channel 212. Oil is supplied from HP oil pump 203 under pressure through supply channel 212, oil filter 232, and oil cooler 224 to one or more subsystems such as a turbocharger 206, bearings 210 and VCT system 218. Oil filter 232 may be any suitable filter for removing oil particulates. For example, oil filter 232 may be a cartridge that removes particulates that are greater than a pore size of the filter. As another example, oil filter 232 may be magnetic and thus, may sequester ferromagnetic particles. As yet another example, oil filter 232 may trap particulates via sedimentation, centrifugal forces, or another method for removing particulates from the oil flow. Thus, oil pumped by HP oil pump 203 within high pressure circuit 270 passes through and is filtered by oil filter 232 located downstream of HP oil pump 203.

After flowing through oil cooler 224, oil may be delivered to various subsystems and their components. In the example of FIG. 2, turbocharger 206 receives oil via channel 216, bearings 210 receive oil via channel 220 and VCT system 218 receives oil via channel 236. In the example depicted herein, bearings 210 and VCT system 218 are part of cylinder head and engine block region 202 introduced in FIG. 1. Additional oil subsystems may include lubrication passageways for delivering oil to moving components, such as to the camshafts, cylinder valves, etc. Still further non-limiting examples of oil subsystems include cylinder walls, miscellaneous bearings, etc. Oil exits turbocharger 206, bearings 210, and VCT system 218 via channels 223, 226 and 228 respectively. Oil returns to oil sump 201 at atmospheric pressure through return channel 230.

As FIG. 2 depicts, high pressure circuit 270 and low pressure circuit 250 share a common oil sump 201. Thus, engine oil is pumped via LP oil pump 204 to piston cooling jets 208 and is returned to oil sump 201 without being pumped by HP oil pump 203. Likewise, engine oil pumped via HP oil pump 203 to bearings, VCT system or the turbocharger is returned to the sump without being pumped by LP oil pump 204. Therefore, each of the higher and lower pressure oil pumps draw oil from a common, shared sump, and returns oil back to the common, shared sump. Further, LP oil pump 204 supplies oil only to the first group of components (herein, including the piston cooling jets), and does not supply oil to the second group of components (herein, including the cylinder head, bearings, a variable valve operation system such as the VCT system, and the turbocharger). Likewise, HP oil pump 203 provides oil to each of the cylinder head, bearings, the variable valve operation system, and the turbocharger, and does not supply oil to the piston cooling jets.

LP oil pump 204 may be sized differently from HP oil pump 203 since the LP pump supplies oil to components, such as piston cooling jets, that demand oil at higher flow rates and lower pressures. Therefore, the LP oil pump may be selected to provide a higher flow rate than the HP oil pump. On the other hand, since HP oil pump 203 supplies oil to components requiring oil at higher pressures and lower flow rates, the HP oil pump may be sized to provide a lower flow rate at a higher pressure than LP oil pump. Further, since piston cooling may be demanded only under high load and hot oil conditions, the LP oil pump may be deactivated when these conditions are absent. Similarly, the HP oil pump may be dynamically controlled based on cam phasing and lubrication requirements.

As used herein, a circuit generally refers to a cyclic loop in that oil is suctioned from the sump, delivered to one or many features of engine 10, and returned to the oil sump for redistribution. Oil drawn by the pumps may be delivered to the various engine components and may be returned to oil sump 201 in any suitable way. For example, one or more oil return passages may channel oil directly to the oil sump. The illustrated embodiment shows that low pressure circuit 250 may draw oil in via intake channel 214 and may return oil to oil sump 201 via return channel 234. Oil drawn in via channel 212 by high pressure circuit 270 may be returned to oil sump 201 via channel 230. As another example, oil may drip from various components, wherein the oil drips are collected by the oil sump as a result of gravitational forces.

It will be appreciated that in alternate examples, a no-pressure check valve may be included in low pressure circuit 250, downstream of LP oil pump 204 to prevent reverse flow. In one example, the check valve may be a 2 bar check valve. In another example, a low pressure check valve may be utilized if the LP oil pump and the HP oil pump share a common, oil drawing channel.

It will be further appreciated that oil delivery system 200 is provided by way of example, and thus, is not meant to be limiting. Rather, oil delivery system 200 is provided to introduce a general concept, as various configurations are possible without departing from the scope of this disclosure. Thus, it will be appreciated that FIG. 2 may include additional and/or alternative components than those illustrated. For example, in some embodiments, the low pressure and high pressure circuits may share a common suction passage. Further, some components may be omitted from the example oil delivery system without departing from the scope of this disclosure. For example, in some embodiments one or more valves may be excluded. As another example, a cooler may be absent from one of the circuits.

In this way, two separate oil circuits may be used to provide oil at different pressures and different flow volumes to distinct engine components. Components, such as piston cooling jets, requiring oil at lower pressure and a higher flow rate may be supplied solely by the LP oil pump whereas components, such as bearings, VCT system, turbocharger, etc., requiring oil at higher pressure and lower flow rates, may receive oil exclusively from the HP oil pump. Therefore, each pump may be sized according to the demands of components coupled thereto. Further, by using electric oil pumps instead of pumps driven by the crankshaft, components can be cooled even when the engine is at rest.

An engine controller 12 may be configured to select a mode of oil system operation, with one or more of the LP and HP oil pumps being operated, based on engine operating conditions and engine oiling and cooling requirements. For example, controller 12 may be configured with code on non-transitory memory for performing control routines such as those illustrated in FIGS. 3-5. Routine 300 in FIG. 3 selects a specific mode of oil delivery based on engine operating conditions. Routine 400 in FIG. 4 details the operation of the LP oil pump (herein, also known as LP pump) based on various engine parameters. Routine 500 in FIG. 5 depicts the operation of the HP oil pump (herein, also known as HP pump) based on engine operating conditions.

Figure 3:
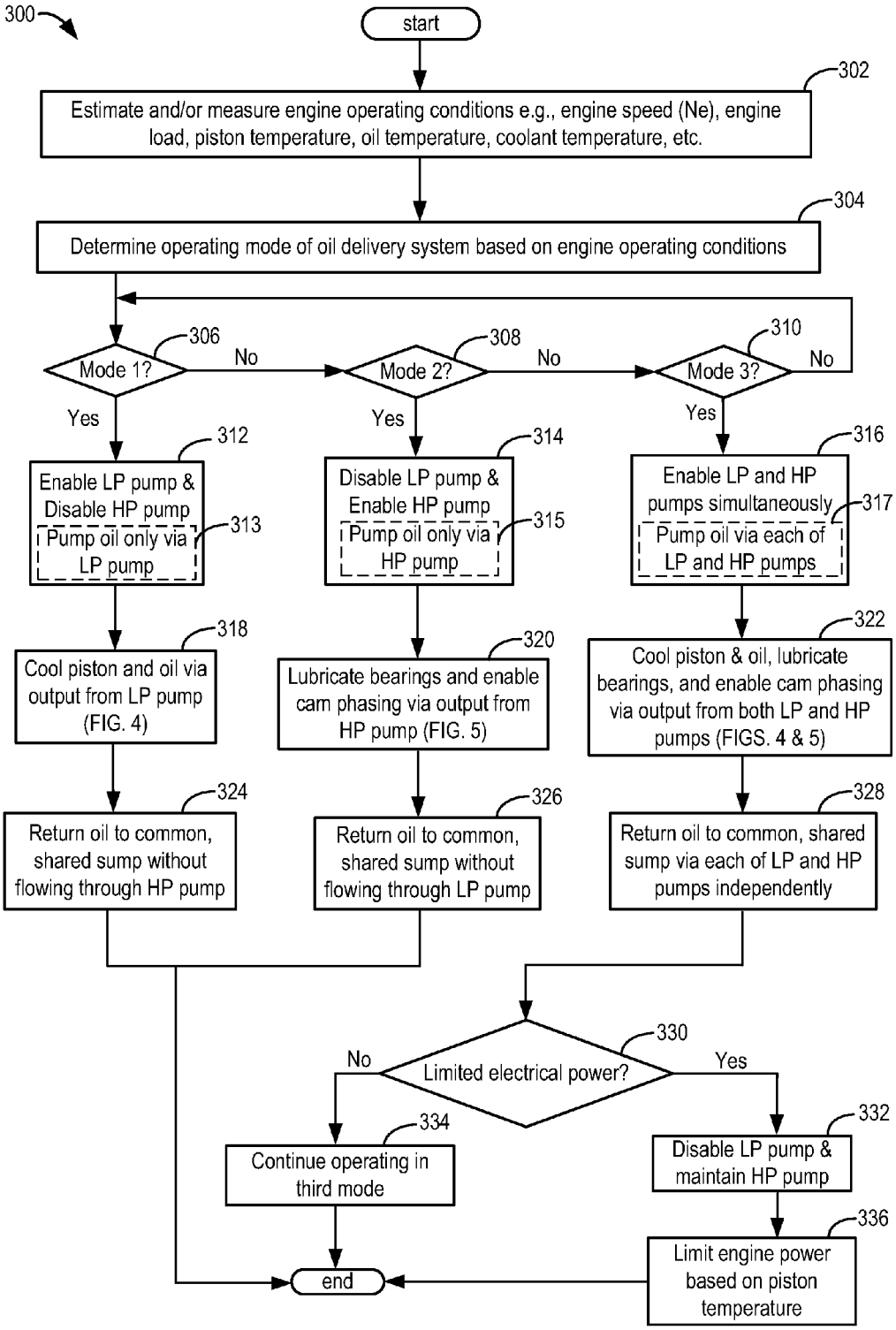
FIG. 3 is an example flowchart illustrating a method to determine a mode of operation for the example engine oil delivery system of FIG. 2.

Turning now to FIG. 3, it shows an example routine 300 for selecting a mode of operation for the oil delivery system of FIG. 2. Specifically, one of three modes of operation may be selected depending upon parameters such as piston temperature, oil temperature, engine speed and VCT phasing.

At 302, engine operating conditions may be measured and/or estimated. Engine operating conditions include engine speed (Ne), engine load, boost level, valve timing, engine temperature, piston temperature, oil temperature, coolant temperature etc. At 304, routine 300 may determine a mode of oil delivery based on engine conditions measured and/or estimated at 302. For example, a different operating mode may be selected when the engine is operating at a lower engine speed as compared to when the engine speed is higher.

At 306, it may be determined if engine conditions for operating in a first mode (mode 1) are present. As one example, the first mode may be selected if the piston temperature is higher. As such, in the first mode, only the LP pump is operated.

If the first mode is confirmed, at 312, the LP pump may be enabled and operated while the HP pump is maintained disabled. Therefore, at 313, oil from the sump may be pumped only by the LP pump. For example, soon after an engine shut down when the engine is at rest, the piston may be cooled by operating the LP pump. With the engine at rest, the HP pump may be disabled since lubrication to bearings, turbocharger parts or VCT changes may not be requested. Thus, oil may not be pumped to the group of components coupled to the HP pump, such as the bearings, turbocharger or a variable valve operation system, during the first mode.

At 318, therefore, LP pump operation may be used to cool the piston and the oil. LP pump operation will be further elaborated in the description of FIG. 4. In one example, after the engine has spun to rest, the oil temperature may be higher than a threshold but the piston may be cooler. Herein, LP pump operation may be used to pump oil through the oil cooler in the low pressure circuit. The oil may be pumped at a lower speed so that it does not squirt onto the piston but gurgles out of the piston cooling jets back into the oil sump.

At 324, oil pumped by the LP pump may be returned to the common, shared oil sump. As described earlier in reference to FIG. 2, the LP pump is part of the low pressure circuit and functions independently of the HP pump. Thus, oil pumped by the LP pump into the low pressure circuit flows separately and specifically to piston cooling jets, and returns to the oil sump without being pumped by the HP pump. To elaborate, oil drawn by the LP pump flows through the low pressure circuit and returns to the oil sump without encountering the HP pump or the high pressure circuit.

Returning to 306, if a first mode of oil delivery is not confirmed, at 308, it may be determined if engine conditions for operating in a second mode (mode 2) are present. As one example, the second mode may be selected if the engine is operational and miscellaneous bearings require lubrication. As such, in the second mode, only the HP pump is operated. If the second mode of operation is confirmed, at 314, the HP pump may be enabled while concurrently disabling the LP pump and at 315, oil may be pumped only via the HP pump. For example, at an engine start, particularly a cold start, the piston may be cooler and piston cooling may not be commanded. Therefore, oil may not be pumped by the LP pump for piston cooling during the second mode (mode 2) of operation.

However, at engine start and when the engine is operational, bearings in the engine block and cylinder head may request lubrication and the HP pump may be activated. At 320, therefore, the HP pump may provide oil to lubricate bearings and enable changes in valve timing via cam phasing. HP pump operation will be elaborated in the description for FIG. 5. At 326, oil pumped by the HP pump may be returned to the common, shared oil sump without flowing through the LP pump. As depicted in FIG. 2, the HP pump functions as part of the high pressure circuit which operates separately from the LP pump and the low pressure circuit. Thus, oil drawn in by the HP pump flows only through the high pressure circuit and is returned to the oil sump without flowing through the low pressure circuit.

Returning to 308, if a second mode of oil delivery is not confirmed, at 310, it may be determined if engine conditions for operating in a third mode (mode 3) are present. As one example, the third mode may be selected if the engine is operational and the piston requires cooling. As such, in the third mode, both the HP and the LP pumps are operated concurrently. If conditions for operating in the third mode are not confirmed at 310, routine 300 returns to 306.

If the third mode of operation for the oil delivery system is determined at 310, routine 300 continues to 316 where the LP pump and the HP pump may be activated and operated simultaneously. Thus, at 317, oil may be pumped by both the HP and the LP pumps. At 322, output from the LP pump may cool the piston and the oil while output from the HP pump may lubricate bearings and enable cam phasing. Further details of operation of the HP and LP pumps will be described in reference to FIGS. 4 and 5. At 328, oil flowing via the LP pump may be returned to the common, shared sump independent of oil flowing through the HP pump.

From 324 and 326, routine 300 may end. However, from 328, routine 300 proceeds to 330 to verify if electric power supply to the pumps is limited. For example, if an alternator that supplies power to the system battery is degraded, electric power supply to the pumps may be reduced. If electrical power to the pumps is limited, at 332, the LP pump may be disabled while continuing operation of the HP pump. Further, at 336, engine power may be regulated to maintain a cooler piston temperature to avoid a demand for piston cooling. For example, engine power may be limited by limiting boost. If, at 330, it is determined that adequate electrical power is available for both pumps to operate simultaneously, at 334, pump operation in the third mode is continued.

In this way, during a first mode of engine oil system operation, oil may be pumped through a low pressure circuit to only a first group of components including piston cooling jets via a lower pressure engine oil pump. During the first mode, a higher pressure pump may be disabled and therefore, oil is not supplied to a second group of components including a cylinder head, a variable valve operation system, and a turbocharger etc., that are coupled to the HP pump. Likewise, during a second mode of engine oil system operation, oil may be pumped through the high pressure circuit to only a second group of components including a cylinder head, bearings, a variable valve operation system, such as a VCT system, and a turbocharger via a higher pressure engine oil pump. During the second mode, the lower pressure pump in the low pressure circuit may be deactivated and thus, oil may not be provided to the first group of components, such as piston cooling jets. Finally, during a third mode of engine oil system operation, both pumps may operate simultaneously and supply oil to their respective components including a cylinder head, bearings, turbocharger, piston cooling jets and the variable valve operation system. An example of an engine oil system operation in the third mode may be during acceleration on the highway.

Figure 4:
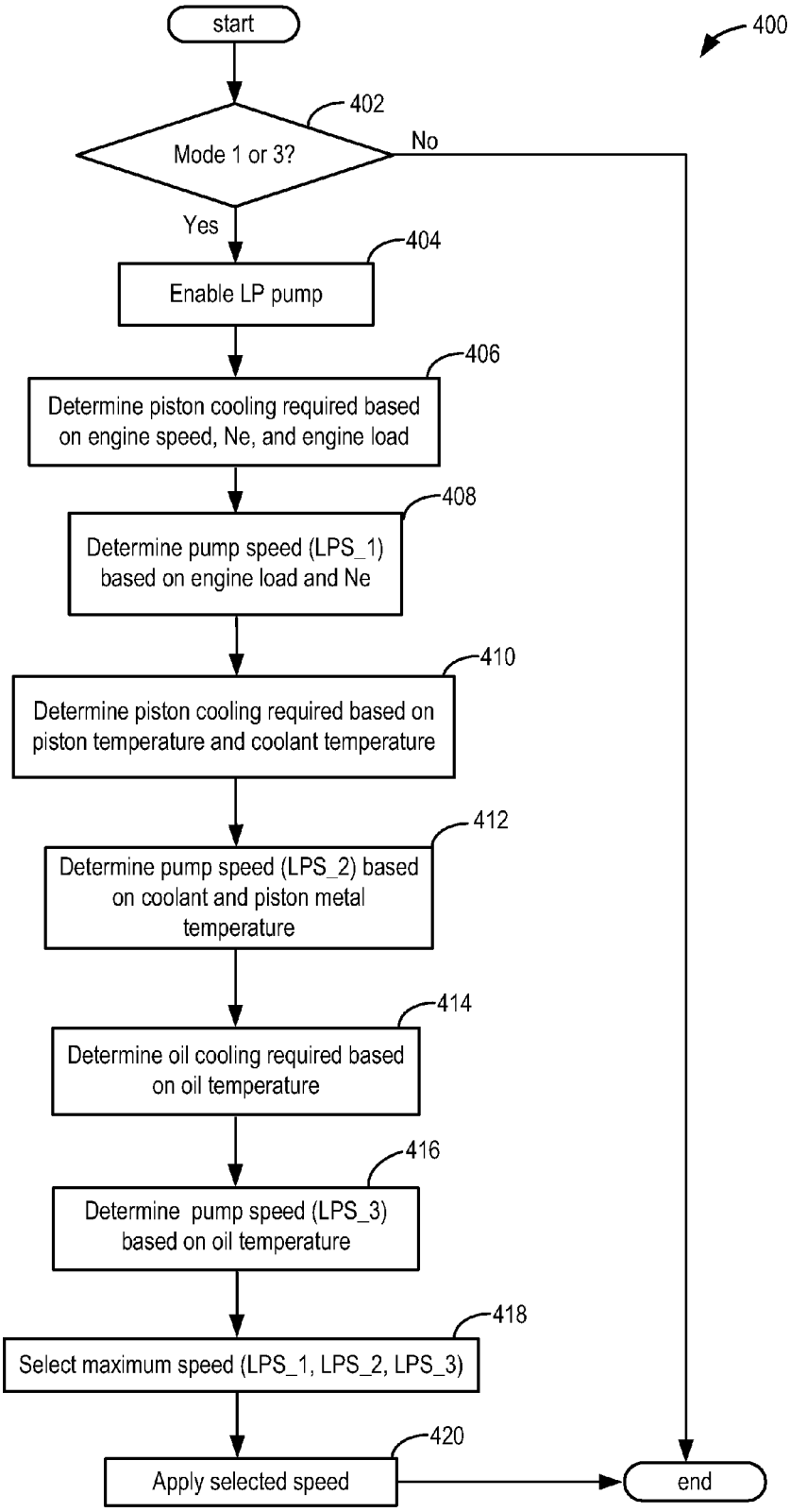
FIG. 4 depicts an example flowchart for controlling a lower pressure oil pump based on engine conditions and requests from the components coupled to the lower pressure oil pump.

Turning now to FIG. 4, it shows an example routine 400 that details the control of a lower pressure (LP) oil pump during the first and third modes of operation. Specifically, routine 400 determines and adjusts an output of the LP pump, e.g. pump speed, based on existing engine conditions. Pump output may include one or more of pump output, pump speed, pump flow rate, pump output volume or pressure.

At 402, it may be confirmed that the oil delivery system is operating in either a first mode or a third mode. The mode of operation may be selected, as described earlier in reference to FIG. 3, based on engine operating conditions. If it is determined that the oil delivery system is not operating in either of these two modes, routine 400 ends. However, once it is confirmed that the oil delivery system is operating in either the first mode or the third mode, the LP pump may be enabled at 404. Enabling the pump includes operating the first electric motor coupled to the LP pump. At 406, a piston cooling requirement may be determined based on engine speed and engine load. For example, piston cooling may be required due piston temperatures reaching higher temperatures during high load conditions. In one example, a high load condition may occur when the vehicle is towing large loads. In another example, a high load condition may occur during high speed operation on the highway. At 408, a pump output, such as a pump speed, LPS_1, may be determined based on the measured engine speed and estimated engine load. For example, the controller may use a look-up table stored as a function of engine load and engine speed to determine a pump output LPS_1 required to provide the determine piston cooling.

At 410, routine 400 may determine a piston cooling requirement based on a measured piston temperature and coolant temperature. For example, an infrared sensor may sense the piston temperature. The coolant temperature may correlate with the oil temperature since coolant may extract heat from oil flowing through the oil cooler. As such, piston and oil temperatures may need to be maintained below a threshold temperature. A deviation of the measured piston and coolant temperature from a minimum threshold for each of the piston temperature and coolant temperature may be utilized to determine a piston cooling requirement at 410. At 412, a pump output speed, LPS_2, may be determined by the controller based on piston temperature and coolant temperature. For example, a look-up table stored in the controller's memory as a function of coolant temperature and piston temperature may be used to determine a pump output LPS_2 required to provide the determined piston cooling.

At 414, routine 400 may determine an oil cooling requirement based on oil temperature. The LP pump may be activated if the oil temperature rises above a minimum threshold. Oil temperature may be measured by a temperature sensor within the oil sump. In another example, an estimated coolant temperature may be used to infer oil temperature since coolant may extract heat from oil flowing through the oil cooler. Thus, oil cooling may be desired even when piston cooling jets are not commanded. At 416, a pump output speed, LPS_3, may be determined based on oil temperature. For example, a sufficiently low pump speed may be determined such that oil does not squirt up towards the pistons but flows through the cooler and out of the piston cooling nozzles, and returns to the common sump.

At 418, a maximum of the pump output speeds LPS_1, LPS_2, and LPS_3 may be selected and applied. For example, if the vehicle is towing a heavy load and engine load is higher, LPS_1 may be the highest of the three determined speeds. In this situation, controller 12 may operate the LP pump at LPS_1. In another example, if the engine is at rest and the pistons are cooler, LPS_3 may be the highest speed. Herein, the pump may be operated at LPS_3 and the oil may flow through the cooler in the low pressure circuit without squirting onto the piston undersides. In this way, the output of the low pressure pump may be adjusted to meet the highest cooling and lubrication requirement of the group of components serviced by the low pressure pump. Finally, at 420, the selected speed may be applied to the LP pump.

While the depicted example shows selecting and applying a pump output speed, in alternate examples, the controller may adjust a pump output pressure, flow rate, or other pump output parameter.

It will be appreciated that the LP pump may operate at a speed, pressure and flow rate such that adequate oil sprays onto the pistons to promote cooling of said pistons. The minimum pressure at the nozzle of the piston jets can be calculated using Bernoulli's equation. An elevation that the oil spray has to traverse to reach the piston surface may be converted to a pressure or velocity of spray. Further, the pressure and velocity of the oil jet has to overcome aerodynamic drag and reach a desired location on the piston surface.

In this way, the LP pump may be selectively activated and the output may be based on one or more of engine load, engine speed, piston temperature, coolant temperature, and oil temperature.

Turning now to FIG. 5, it shows an example routine 500 for determining and adjusting the output of a higher pressure (HP) pump. Specifically, the output of the HP pump, e.g. pressure, may be adjusted based on engine speed, an upcoming cam phasing and/or a tip-in condition. Pump output may include one or more of speed, pressure, pump flow rate, and volume.

At 502, it may be confirmed that the oil delivery system is operating in either a second mode or a third mode. The mode of operation may be selected, as described earlier in reference to FIG. 3, based on engine operating conditions. If it is determined that the oil delivery system is not operating in either of these two modes, routine 500 ends. On the other hand, if it is confirmed that the oil delivery system is operating in either the second mode or third mode, at 504, the HP pump may be activated by operating an electric motor coupled to the HP pump. For example, HP pump may be enabled when the engine is operational and spinning.

At 506, lubrication demands from various bearings within the engine may be determined and at 508, a pump output, HPP_1, may be determined based on engine speed to meet the lubrication demand. In one example, a look-up table stored in the controller's memory as a function of engine speed may be used to determine HP pump output.

At 510, cam phasing demands by the VCT system may be determined based on engine operating conditions. For example, if a valve timing change is anticipated, the cam phaser may be shifted via hydraulic pressure. VCT phasing may be determined by calculating a desired rate of phase difference, at 512, and by determining cam shaft friction based on oil and head temperature, at 514. A phaser error may be included in the determination of cam shaft friction, at 514, wherein the error is saved as a function of oil and head temperature.

At 516, a pump pressure output, HPP_2, may be determined based on oil temperature and cam phasing rate. For example, if the phasing rate is higher, a higher pump pressure may be required. At 518, it may be verified if a tip-in condition exists. A tip-in condition may be determined based on a change in accelerator pedal position. In another example, a tip-in condition is confirmed if the rate of change in load is higher than a threshold. For example, a tip-in condition may demand torque promptness and combustion robustness. If a tip-in condition is confirmed, at 520, a pump output, HPP_3, may be determined as a function of oil temperature and the change in engine load. At 524, a maximum of pump outputs HPP_1, HPP_2 and HPP_3 may be selected and applied.

If at 518, a tip-in is not confirmed, at 522, a maximum pump output of HPP_1 and HPP_2 is chosen and applied. At 526, the selected pump output based on either 522 or 524 may be applied to the HP pump. In this way, the output of the high pressure pump may be adjusted to meet the highest cooling and lubrication requirement of the group of components serviced by the high pressure pump. Thus, if oil is requested from the HP pump to lubricate crankshaft bearings within the turbocharger and a VCT phasing change is not anticipated, a lower HP pump pressure may be selected. On the other hand, if the VCT system requests oil pressure for an upcoming valve timing change, the HP pump output may be at a higher pressure.

In this way, the output of the HP pump may be adjusted based on one or more of oil temperature, a VCT phasing rate, engine speed and a change in engine load. The example output chosen to describe FIG. 5 above is pump pressure but it will be appreciated that other outputs of the pump may also be modified in a similar manner. These outputs include one or more of the HP pump speed, pressure, flow rate, or other pump parameters.

In this way, a controller may be configured to operate the oil delivery system in a first mode with only the LP pump enabled responsive to a higher engine load and speed, piston temperature and oil temperature. A second mode of operation may be selected with only the HP pump enabled, in response to lubrication requirements and cam phasing rates. Further, a third mode of operation, with both pumps activated simultaneously, may be chosen in response to a higher piston temperature, a higher oil temperature, cam phasing requirements, lubrication requirements and higher engine load.

An example operation of the oil delivery system, in accordance with the present disclosure, is shown at FIG. 6. Specifically, the three modes of operation based on engine conditions are shown. Map 600 depicts an output of a LP pump at 602, an output of a HP pump at plot 604, oil temperature at plot 606, pedal position at plot 608, and engine speed (Ne) at plot 610 plotted against time on the X-axis. Additionally, line 605 represents a minimum threshold for the oil temperature above which oil cooling via the LP pump may be initiated.

Before t0, the vehicle is at rest with an engine shut down. For example, the vehicle may be parked overnight. Therefore, oil temperature is at a minimum and with the vehicle being keyed off, both the pumps are shut down. At t0, the engine may be turned on and may start spinning at idle speed. Therefore, the oil temperature may increase slightly and the HP pump may be activated to lubricate bearings within the engine and the turbocharger. The LP pump remains disabled since the piston may not require cooling at a cold start.

At t1, the pedal may be pressed gently and the engine speed may increase simultaneously. Between t1 and t2, the pedal position stabilizes as does the engine speed, and the oil temperature increases slowly. The HP pump remains activated to lubricate different parts of the engine. If a valve timing change occurs between t1 and t2, the HP pump output may be correspondingly increased, as shown at dotted segment 603, to enable the requested cam phasing. As soon as the valve timing change is achieved, the HP pump pressure resumes the previous output level as prior to 603. While only a single cam phasing is shown, between t1 and t2, there may be multiple such cam phasings depending on engine speed variation, emissions, etc. In each case, the HP pump output may be correspondingly adjusted based on the cam phasing demand. Since the oil temperature remains below threshold 605, the LP pump remains disabled between t1 and t2. Therefore, the oil delivery system is operating in the second mode between t0 and t2 with the HP pump enabled and the LP pump being disabled.

At t2, a tip-in occurs wherein the pedal position is pressed into a wide open throttle position. For example, the vehicle operator may be accelerating on a highway. Corresponding to this pedal position, the engine speed rises as does the HP pump pressure and the oil temperature crosses threshold 605. Since LP pump output depends on oil temperature, engine speed and load, the LP pump is activated at t2 and its output is increased in proportion to the change in oil temperature and engine speed to enable piston cooling and oil cooling. At t3, the pedal may be released and the engine speed correspondingly drops. The HP pump pressure may reduce after t3, and the LP pump speed may also decrease and stabilize to provide piston and oil cooling. Therefore, between t2 and t4, the oil delivery system is operating in the third mode wherein both pumps are operating simultaneously.

Between t3 and t4, the vehicle may slow down and eventually at t4, stop and come to a rest, e.g. at a traffic light. During such a start-stop condition, the engine may shut down and spin to a rest at t4. Therefore, at t4, the HP pump is deactivated since neither lubrication nor cam phasing is anticipated. However, since the oil temperature remains higher than threshold 605, the LP pump may continue to operate at a low speed to cool the oil. Thus, between t4 and t5, the oil delivery system is operating in the first mode with the LP pump enabled and the HP pump in a deactivated state.

At t5, the vehicle may start moving, the pedal is depressed and the engine speed rises. At the same time, the HP pump is activated. However, since the oil temperature has fallen to below the threshold prior to t5, the LP pump may be deactivated at t5. However, if the engine speed, engine load or oil temperature increase sufficiently, the LP pump may be activated again.

In this way, an oil delivery system comprising two separate oil circuits coupled to different components may be used to reduce hydraulic power loss. A low pressure circuit with a lower pressure pump may selectively supply oil to components requesting oil at lower pressures. Likewise, a high pressure circuit with a higher pressure pump may supply oil only to those components demanding oil at higher pressures. Each pump may be sized according to the needs of the components it is coupled to, thus providing a reduction in power consumption. By activating each pump, and adjusting its output, based on component demand, a reduction in hydraulic work and an improvement in fuel economy can be achieved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine comprising:

simultaneously pumping oil via a lower pressure oil pump to piston cooling jets while separately pumping oil via a higher pressure oil pump to a cylinder head with electrical power; and responsive to a determination that electrical power to the pumps is limited, disabling the lower pressure oil pump while continuing operation of the higher pressure oil pump and limiting engine boost.

2. The method of claim 1, wherein the oil pumped via the lower pressure oil pump is returned to a sump without being pumped by the higher pressure oil pump.

3. The method of claim 2, wherein the oil pumped via the higher pressure oil pump is returned to the sump without being pumped by the lower pressure oil pump.

4. The method of claim 1, wherein each of the higher and lower pressure oil pumps draw oil from a common, shared sump, and return engine oil back to the common, shared sump, and wherein at a given engine operating condition, the lower pressure oil pump pumps oil at a higher flow rate than the higher pressure oil pump.

5. The method of claim 4, wherein the lower pressure oil pump supplies oil only to the piston cooling jets, and does not supply oil to the cylinder head, a variable valve operation system, or a turbocharger.

6. The method of claim 5, wherein the higher pressure oil pump supplies oil to each of the cylinder head, variable valve operation system, and the turbocharger, and does not supply oil to the piston cooling jets.

7. The method of claim 1, wherein the lower pressure oil pump is selectively activated based on one or more of engine load, piston temperature and oil temperature, including determining a first pump speed based on engine speed and load, a second pump speed based on piston temperature, and a third pump speed based on oil temperature, and selecting a maximum of the first, second, and third speeds and setting a speed of the lower pressure oil pump to the selected maximum pump speed.

8. The method of claim 1, further comprising adjusting an output of the lower pressure oil pump by adjusting a first electric motor coupled to the lower pressure oil pump, and adjusting an output of the higher pressure oil pump by adjusting a second electric motor coupled to the higher pressure oil pump.

9. The method of claim 8, further comprising adjusting the output of the lower pressure oil pump based on one or more of engine load, engine speed, piston temperature and oil temperature.

10. The method of claim 9, further comprising adjusting the output of the higher pressure oil pump based on one or more of oil temperature, a variable cam timing (VCT) phasing rate and engine speed.

11. The method of claim 10, wherein adjusting the output of the lower pressure oil pump includes adjusting one or more of a lower pressure pump speed, pump flow rate, and pump pressure output, and wherein, adjusting the output of the higher pressure oil pump includes adjusting one or more of a higher pressure pump speed, pump flow rate, and pump pressure output.

12. The method of claim 1, further comprising, during a first mode operating the lower pressure oil pump and not the higher pressure oil pump, and during a second mode, operating the higher pressure oil pump and not the lower pressure oil pump, and during a third mode, operating both pumps concurrently, the method further including during the second and third modes, adjusting output of the higher pressure oil pump based on oil temperature, a variable cam timing (VCT) phasing rate, and engine speed, including determining a first pump speed based on engine speed, a second pump speed based on the phasing rate, and a third pump speed based on oil temperature and a change in engine load, and responsive to a tip-in, selecting a maximum of the first, second, and third speeds, and if response to no tip-in, selecting a maximum of the first and second speeds, but not the third speed, and then adjusting operation of the higher pressure oil pump to operate at the selected maximum speed.

13. A system comprising:

an engine;

a lubrication system including a first electric oil pump and a second electric oil pump wherein the first electric oil pump is a lower pressure oil pump fluidly coupled to piston cooling jets, and the second electric oil pump is a higher pressure oil pump fluidly coupled to a cylinder head, bearings, a variable valve operation system, or a turbocharger; and a controller with computer-readable instructions stored in non-transitory memory for:

during a first operating mode, pumping oil via only the first electric oil pump, the pumping based on one or more of engine speed, engine load and piston temperature; and during a second operating mode, pumping oil via only the second electric oil pump, the pumping based on engine speed, oil temperature and a variable cam timing phasing rate, and further adjusting a speed of the second electric oil pump based on a change in engine load only responsive to a tip-in.

14. The system of claim 13, wherein oil is not pumped via the second electric oil pump during the first mode, and oil is not pumped via the first electric oil pump during the second mode, the controller including further instructions for, during a third operating mode, operating both pumps concurrently.

15. The system of claim 14, wherein each of the first and the second electric oil pumps draw oil from a common, shared sump, and return oil back to the common, shared sump independent of each other.

16. The system of claim 14, wherein during the first operating mode, the first electric oil pump does not supply oil to any of the cylinder head, the variable valve operation system, and the turbocharger, and wherein during the second operating mode, the second electric oil pump does not supply oil to piston cooling jets, and when operating both pumps simultaneously, responsive to a determination that electrical power to the pumps is limited, disabling the lower pressure oil pump while continuing operation of the higher pressure oil pump and limiting engine boost.

17. The system of claim 14, further comprising an oil filter located downstream of the second electric oil pump, wherein the oil pumped by the second oil pump passes through said oil filter, and wherein the controller is configured to operate in the first operating mode responsive to higher engine load, higher piston temperature, or higher oil temperature, operate in the second operating mode responsive to lubrication and cam phasing requirements, and operate in the third operating mode responsive to higher engine load, higher piston temperature, higher oil temperature, lubrication requirements, and cam phasing requirements.

18. A method for an engine comprising:

cooling a piston with oil received at a lower pressure and a higher flow rate from a first oil pump; and cooling and lubricating a cylinder head with oil received at a higher pressure and a lower flow rate from a second oil pump, including adjusting a speed of the second oil pump based on a change in engine load only responsive to a tip-in.

19. The method of claim 18, wherein the first oil pump is coupled to a first electric motor and the second oil pump is coupled to a second electric motor, and when operating both pumps simultaneously, responsive to a determination that electrical power to the pumps is limited, disabling the first oil pump while continuing operation of the second oil pump and limiting engine boost.

20. The method of claim 19, wherein the first and the second oil pumps each draw oil from a common, shared sump, and return oil back to the common, shared sump.

* * * * *